United States Patent [19]

Chen

[11] 4,333,172

[45] Jun. 1, 1982

[54] METRONOME CARTRIDGE

[76] Inventor: Shin H. Chen, Apartment B, 6333 N. Lakewood, Chicago, Ill. 60660

[21] Appl. No.: 56,983

[22] Filed: Jul. 12, 1979

[51] Int. Cl.[3] ..... G04F 5/02

[52] U.S. Cl. ..... 369/2; D14/11; D10/43; 360/137; 340/309.1; 116/67 A; 84/484

[58] Field of Search ..... 84/484; D14/11; D10/43; 274/1 R; 116/67 A; 340/384 R, 390, 309.1, 309.2; 360/137

[56] References Cited

U.S. PATENT DOCUMENTS 2,240,305 4/1941 Koch ..... 84/454

3,541,916 11/1970 Reid ..... 84/484

3,774,494 11/1973 Reid ..... 84/464

4,090,355 5/1978 Morohoshi ..... 84/454

*Primary Examiner*—George H. Miller, Jr.

*Assistant Examiner*—Stafford D. Schreyer

[57] ABSTRACT

A metronome cartridge comprises a cartridge body adapted to be removably mounted in a cassette player having a pickup head, and tape free mechanical means carried by the cartridge body generates metronomic time signals to the pickup head for amplification by the amplifier system of the cassette player. Visual time or tempo signals, pause control, multiple beat capability, and beat adjustment are provided for.

30 Claims, 10 Drawing Figures

FIG. 6
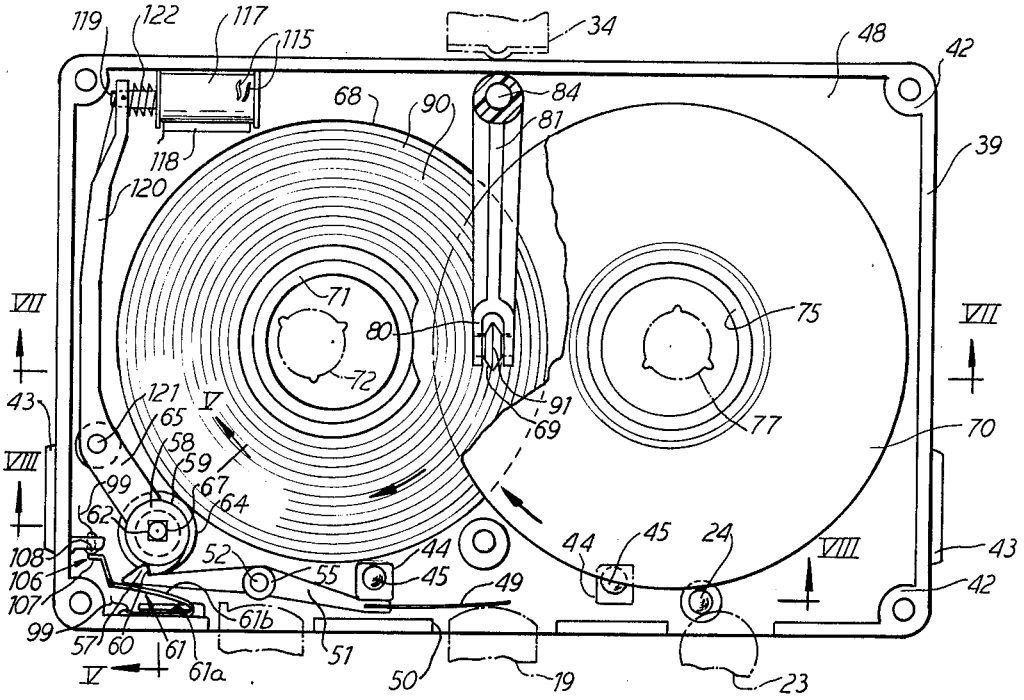
FIG. 7
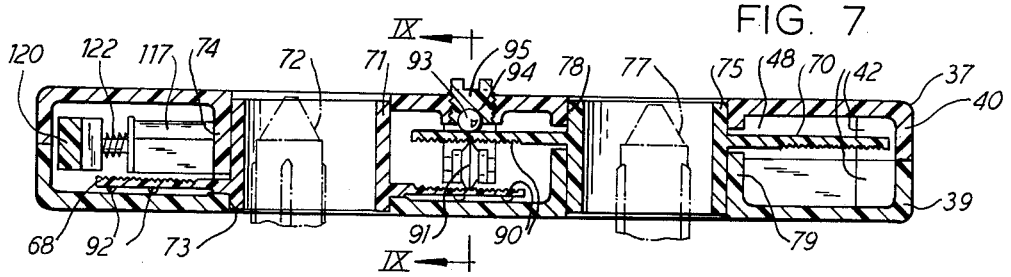
FIG. 8
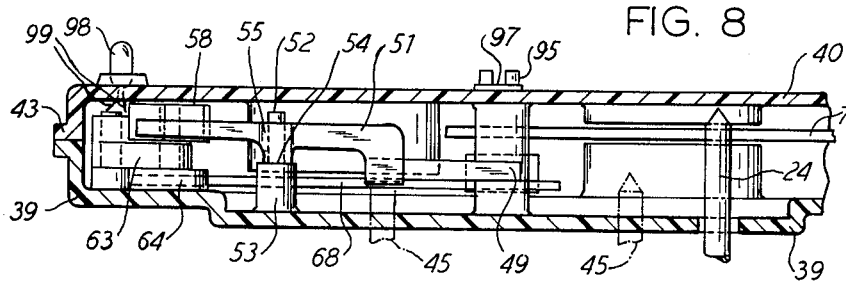
FIG. 9
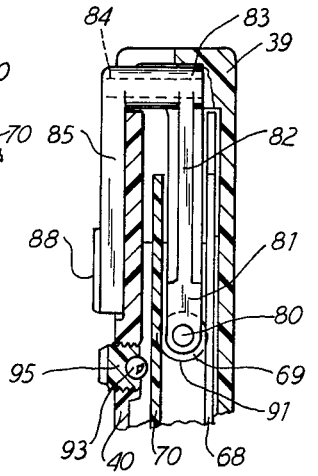
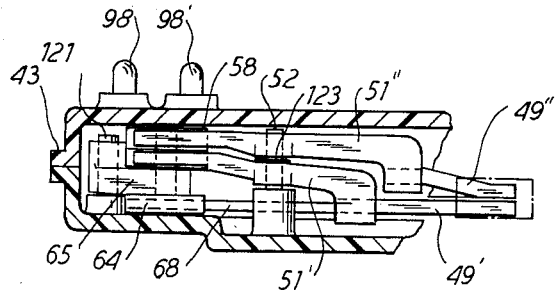
FIG. 10

METRONOME CARTRIDGE

The invention relates to improvements in metronomes and is more particularly concerned with a novel metronome cartridge especially adapted to be removably mounted in a cassette player.

Metronomes are commonly employed in musical instruction and practice for attainment of proper timing.

Cassette recorders/players are highly developed and are obtainable at relatively low cost, are popular, widely distributed and owned, convenient, versatile, and easy to operate. In general, such machines are equipped to receive and operate with fairly standardized cassettes or cartridges, each of which contains a pair of spools and a roll of magnetic tape, which is run in operation past a sensitive pickup head which is capable of either impressing on the tape magnetic signals transmitted via a microphone, or of sensing stored magnetic signals on the tape for amplification by the amplification system of the machine.

While metronomic beat may be recorded on cassette tape and played as desired, such tapes have a limited length and thus time span, and while the intensity of beat may be readily adjusted, the timing of the beat is not readily adjustable on most machines, because most of them run at a fixed rate; and to attain variations in beat, it would require substitution of a cassette having a different tape. Therefore, a large number of cassettes with the various beat timings would have to be maintained unless the machine is equipped with an expensive speed modulator. Further, with a tape metronomic beat, there is no possibility of volitional pause capability such as a teacher or student may wish to inject from time-to-time in the practice of a musical composition or exercise. However, because of the ready availability and convenience of cassette players, the use of such machines for metronomic timing in musical instruction and practice would be highly desirable.

It is, therefore, an important object of the present invention to provide a novel metronome cartridge which is adapted to be employed in a cassette player for generating metronomic time signals, utilizing the power system, the pickup head and the amplification system of the player.

Another object of the invention is to provide a novel metronome cartridge having versatile time or beat adjustment capability.

A further object of the invention is to provide a novel metronome cartridge capable of visual time or tempo signals as well as generating metronomic time signals to the pickup head of a cassette player.

Still another object of the invention is to provide a novel metronome cartridge which provides for volitional pause control.

Yet another object of the invention is to provide a novel metronome cartridge that has multiple beat capability.

A still further object of the invention is to provide a metronome cartridge which is constructed and arranged to be received in a cassette player interchangeably with tape cassettes.

There is provided by the invention a metronome cartridge comprising a cartridge body adapted to be removably mounted in a cassette player having a driving means, a pickup head and an amplifier system, and a tape-free mechanical means carried by the cartridge body and adapted to be driven for generating metronomic time signals in the operation of the player.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 6 is a top plan view of the metronome cartridge with the top cover removed;

FIG. 7 is a longitudinal sectional detail view taken substantially along the line VII—VII of FIG. 6;

FIG. 8 is a fragmentary sectional detail view taken substantially along the line VIII—VIII of FIG. 6;

FIG. 9 is a fragmentary sectional detail view taken substantially along the line IX—IX of FIG. 7; and FIG. 10 is a fragmentary sectional elevational view similar to FIG. 8, but showing a modification for attaining multiple beat signals.

Figure 1:
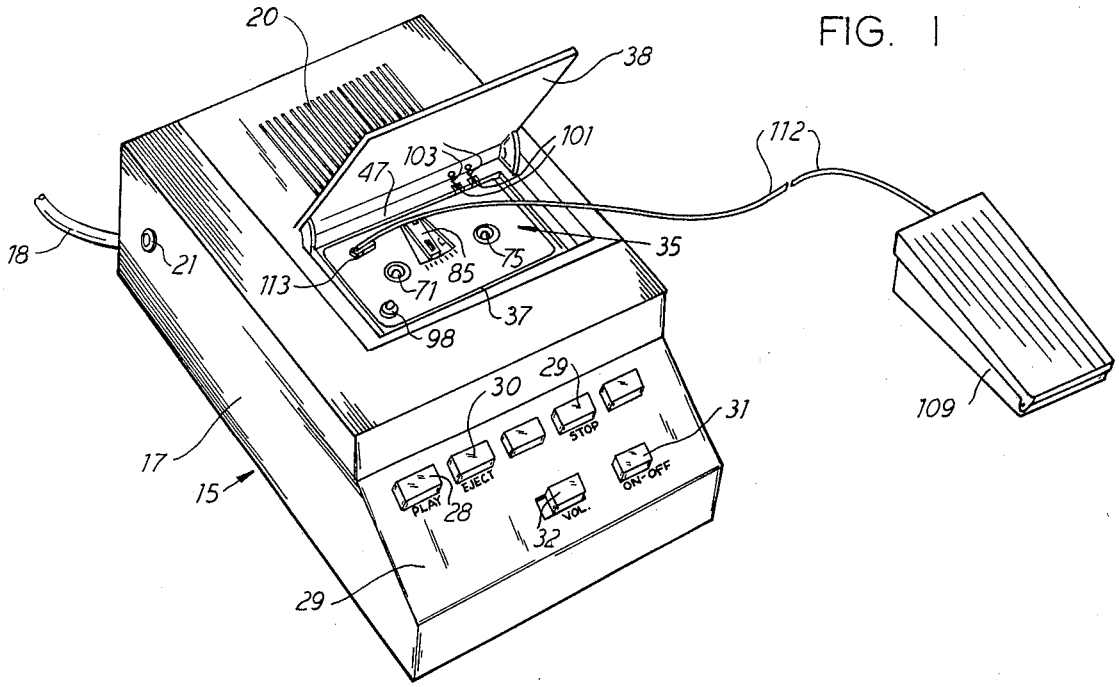
FIG. 1 is a perspective view of a cassette player equipped with a metronome cartridge embodying features of the invention.

On reference to FIG. 1, there is depicted a representative cassette player 15, which may, of course, also have recording capability. Players of this kind are electronically equipped within a housing 17 to function when supplied with electrical energy from batteries or house electrical current through a conventional electrical cord 18 to receive magnetic signals through a pickup head 19 (FIG. 2) for amplification by the amplifier system of the machine including a speaker 20. In addition, or alternatively, the amplifier system of the player 15 may be tapped through an outlet or receptacle 21 by a headset plug. As is customary, the player 15 has recessed within the top of the housing 17, a cassette-receiving well 22 into the front of which the pickup head 19 is adapted to project during playing or recording operation of the machine, together with a frictional pressure roller 23 which during tape cassette operation serves to press the tape against a capstan 24 driven at a constant speed. Also projecting into the front of the well 22 with the head 19 is a cassette hold down and rearward pressure finger 25. In the front bottom of the well 22 is a cassette eject finger 27. All of the elements 19, 23 and 25 are, of course, mounted in customary fashion on a projectable and retractable carriage (not shown) under the control of means such as a play button 28 and a stop button 29. The eject finger 27 is operable by an eject button 30. Also on the control panel 29 is an on-off switch button 31 and a volume control button 32. At the back of the well 22 is a sensor finger 33, and a spring 34 constructed and arranged to bias a cassette forwardly.

According to the present invention, there is provided a metronome cartridge 35 which is adapted to be removably mounted in the well 22 of the cassette player 15. For this purpose, the cartridge 35 comprises a hollow housing 37 which is dimensioned within substantially the geometry of a standard tape cassette, being generally rectangular in plan, and of an overall thickness or height to permit the cartridge to be received within the well 22 and a well top closure 38 on the top of the player 15 to be closed over the cartridge 15 if desired.

In a perferred construction, the cartridge body 37 comprises a base member 39 and a cover member 40, which are equipped with perimeter flanges projecting toward one another and engaged edgewise in assembly. Both of the base and cover members 39 and 40 may be molded from suitable rigid plastic material. Means for separably securing the complementary body members 39 and 40 in assembly may comprise screws 41 (FIG. 2) secured into integral internal corner bosses 42 on the members 39 and 40 (FIGS. 6 and 7). For maintaining a stable position within the well 22, although ample clearance is provided about the perimeter of the housing 37 relative to the walls defining the well 22 as best visualized in FIG. 2, the opposite sides of the body 37 may be provided with side stabilizing bosses 43. Front to rear stability is efficiently attained by means of a pair of spaced holes 44 located in the front portion of the bottom of the base member 39 and providing along their rear edges shoulders engageable with upstanding stabilizer pins 45 on the bottom of the well 22 and cooperatively related to the biasing spring 34 located centrally in the back of the well 22 and thrusting toward the back of the cartridge body 37. Through this arrangement, the cartridge 35 can be easily inserted into position within the well 22 in the customary manner of inserting a tape cassette, by thrusting the rear portion of the body 35 in under the customary overhanging flange 47 overhanging the rear portion of the well 22 and against the bias of the spring 34, and then dropping the front portion of the cartridge down to engage the upwardly tapered pins 45.

Within the assembled body members 39 and 40 is defined a hollow housing chamber 48 within which means are carried by the cartridge body 37 for generating metronomic time signals to the pickup head 19 for amplification by the amplifier system of the player 15. For this purpose, at least one signal generating reed 49 (FIGS. 6 and 8) is mounted to extend within the chamber 48 across a clearance opening 50 in the front wall of the cartridge body 37 through which the pickup head 19 projects operatively, so that the reed 49 can be moved into and out of operative relation to the magnetic field of the pickup head and which may comprise striking the live spot on the head. Where, as is customary, the pickup head 19 is magnetic, the reed 49 should also be of magnetic material such as ferrous leaf spring material.

Means are provided for oscillating the reed 49 in any preferred timed sequence relative to the live spot on the pickup tip of the pickup head 19 and thereby generate the desired metronomic time signals. For this purpose, a proximal end of the reed 49 is mounted on one end of a rocker arm 51 which is intermediately pivotally mounted as by means of an upstanding pintle projecting from the top of a boss 53 preferably integral with and projecting upwardly from the bottom wall of the base member 39 and affording an upwardly facing thrust bearing 54 for a journal 55 on the arm 51 through which the pintle 52 extends.

At the end of the rocker arm 51 opposite to that from which the reed 49 projects, means are provided for effecting timed rocking of the arm, in this instance comprising a follower 57 which engages the perimeter of a rotary timing cam 58. The arrangement is such that at least once in each revolution of the cam 58, the rocker arm 51 is caused to rock in one cycle in which the reed 49 is moved away from the pickup head 19 and then permitted to return to operative relation to the pickup head and thus generate a metronomic time signal.

Although the cam 58 may be equipped to cycle the arm 51 and thus the reed 49, a plurality of times in each rotation of the cam 58, in the instance illustrated, a single cycle in each rotation of the cam is provided for by having the caming perimeter of the cam equipped with a spiral cam surface 59 which in the counterclockwise rotation of the cam 58 as seen in FIG. 6, expands from one end at the base of a drop-off 60. Means in the form of a biasing spring 61 thrusts the follower 57 continuously into engagement with the cam surface 59. At the low end of the cam surface 59, at the base of the drop-off 60, the reed 49 is in engagement with the pickup head 19. As the timing cam 58 rotates, the cam surface 59 thrusts the follower 57 to rock the arm 51 and release the reed 49 from the pickup head 19. Then when the follower 57 reaches the drop-off 60, the follower abruptly drops from the high point of the cam surface 59 to the low point under the bias of the spring 61 and thus snaps the reed 49 sharply against the active tip of the pickup head 19 effecting a magnetic impulse of sufficient amplitude to be picked up as a sound producing signal audibly amplified at the speaker 20 of the player 15, or in headphones that may be plugged into the outlet 21.

In a desirable arrangement, the rotary cam 58 comprises a disk which is keyed to the upper portion of a vertical spindle 62 projecting concentrically rotatably upwardly from a frictional drive wheel 64 through a bracket 65 and sufficiently upwardly to receive the cam 58 which for keying purposes has a nonround, e.g. square, hub aperture 67 to key with a complementary upper end portion of the spindle 62. Through this arrangement, the timing cam 58 is readily replaceable for attaining different timing effects for which other similar rotary cams may be provided.

Rotary power for driving the drive wheel 59 is conveniently derived from the rotary spindle or capstan 24 through a speed regulating transmission comprising, in a desirable form, a thin transmission disk 68 which is in peripheral driving relation to the wheel 64 and which is drivingly connected by means of a transfer roller 69 with a power disk 70 which has its perimeter drivingly engaging the perimeter of the capstan 24 which, as previously explained, is rotatably driven by the machine powered driving wheel 23. In a preferred construction, the thin transmission disks 68 and 70 may be constructed from a rigidly moldable plastic material. Rotary mounting of the disk 68 is by means of a central tubular hub 71 of large enough diameter to remain clear about the left-hand tape reel driving capstan 72. At its lower end, the hub 71 is journaled below the disks 68 in a bearing aperture 73 in the base wall of the base member 39. An upwardly extending portion of the hub 71 is journaled in a depending annular journal flange 74 depending from the top wall of the upper body member 40. Similarly, the disk 70 has a central tubular hub 75 of large enough inside diameter to freely clear a tape reel capstan 77. An upper end portion of the hub 75 above the disk 70 is journaled in a bearing aperture 78 in the top wall of the body member 40, while a depending lower end portion of the hub 75 is journaled in an upstanding complementary annular bearing flange 79 on the bottom wall of the base member 39. For rotatably mounting the power transfer roller 69, it has axial member 80 journaled in the arms of a distal end fork 81 of a mounting arm 82, which at its proximal end has a hub 83 journaled on a fixed upright spindle 84 rising from the bottom wall of the base 39 adjacent to the back wall defining the chamber 48. The purpose of mounting the arm 82 pivotally is that through this arrangement, the transfer roller 69 can be shifted between the overlapping portions of the disks 68 and 69 for modifying the speed ratio of the disks within a substantial range. Thus, although the transmission disk 70 may run at a steady rate, by shifting the transfer roller 69 from side-to-side, the speed ratio of the disk 68 can be increased or diminished relative to the speed of rotation of the disk 70. To facilitate such speed ratio adjustment of the roller 69, means comprising a manipulating arm 85 is rigidly fixed with the upper end of the hub 83 and projects forwardly generally parallel and in overlying spaced relation to the arm 82 and is accommodated in an adjustment limit control recess 87 in the upper face of the cover 40, the opposite sides of which recess provide limit stops upon the range of adjustment movement of the roller 69. An upstanding manipulating handle 88 may be provided on the distal end portion of the adjustment arm 85. An adjustment scale 89 is desirably provided along the front end of the recess 87 to facilitate effecting predetermined adjustments by manipulation of the arm 85.

In order to retain the transfer roller 69 tracked in any preferred adjustment position, the opposing faces of the disks 68 and 70 are desirably provided with matching annular track grooves 90, and the roller 69 is provided with an annular peripheral tracking rib 91 which is complementary to and adapted to ride in the selected track grooves 90. By having the rib 91 properly rounded off, speed ratio adjustment can be easily effected by levering the roller through the medium of the coupled arms 82 and 85 in the axial direction of the roller, which will thus cam from one groove to the next groove as permitted by slight springing of the disks 68 and 70.

To avoid mistracking or track jumping of the roller 69 after a desired adjustment has been effected, means are provided which will enable the tracking adjustment, but which will then hold the chosen tracking relationship. Such means include annular bearing ribs 92 on the underface of the lower disk 68 and effecting minimum friction line contact with the supporting bottom wall of the base member 39. In addition, the upper surface of the upper disk 70 has a ball bearing 93 (FIGS. 7 and 9) thrusting thereagainst in generally overlying relation to the roller 69. A retaining socket 94 for the bearing 93 is provided by a vertically adjustable plug 95 which is threadedly engaged in the top wall of the cover member 40 and has a screwdriver slot 97 in its head accessible at the top of the cover 40 for rotatably adjusting the plug 95 as desired. For example, when it is desired to effect a speed ratio adjustment, the plug 95 may be backed-off by means of a screwdriver or coin inserted in the slot 97, adjustment of the roller 69 effected relative to the disks 68 and 70, and the plug 95 retightened. For example, by having the slot 97 normally oriented in a front to rear direction will assure that proper adjustment of the plug 95 has been effected, since only a partial turn of the plug will accommodate adjustment maneuvering of the roller 69.

In addition to audible heat derived from timed striking of the pickup head 19 by the magnetic reed 49, means are desirably provided for visual timing as by illumination means comprising a small electric light bulb 98 (FIGS. 1, 2, 3, 4 and 8) mounted at a convenient readily observable location on top of the cover 40. A time controlled electrical circuit for the lamp 98 may comprise electrical leads 99 communicating with terminals 100 conveniently located on the rear portion of the cover 40 to underlie the housing flange 47 (FIGS. 2 and 3) for electrical engagement with resilient electrical friction contact fingers 101 mounted on the flange 47 which serves as a supporting ledge therefor. Connected to the fingers 101 are respective terminals 102 of electrical leads 103 extending from within the housing 17 and carrying appropriate voltage from suitable tap means associated with the electrical apparatus of the cassette player 15.

For controlling the electrical circuit to the lamp 98 in timed coordination with the reed 49, a switch 104 (FIGS. 4 and 6) is provided which conveniently utilizes the biasing spring 61 for the purpose. To this end, the biasing spring 61 is electrically conductive and is of generally hairpin shape having a base portion **61*a* mounted on the adjacent upstanding inside front wall of the base 39 and a resiliently flexible biasing spring arm 61*b* in engagement with and pressing against the cam follower 57. On the free terminal of the spring 61, there is provided an electrical contact foot 107 which engages a fixed switch contact 108 at each stroke of the reed 49 against the pickup head 19, that is each time the follower 57 drops from the high point of the cam 59. As the switch 106 is closed, the electrical circuit through the leads 99 to the lamp 98 is closed, thus illuminating the lamp 98, and then the circuit is promptly broken as the switch is opened by operation of the cam follower 57, in coordination with backing off of the reed 49 from the pickup head 19. Where it is desired to employ only visual beat signal through the lamp 98, the audio may be shut off by operation of the volume button 32**. Generally, however, coordinated operation of the audible and visual signaling devices may be perferred.

Figure 2:
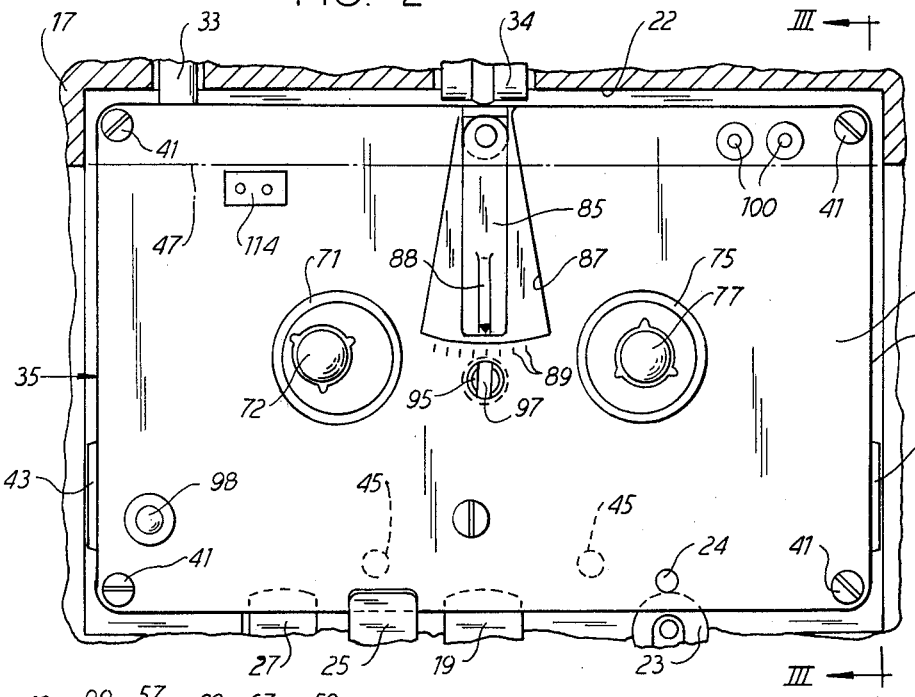
FIG. 2 is an enlarged top plan view of the metronome cartridge and fragmental illustration of the cassette player structure within and about the cassette-receiving well.
Figure 3:
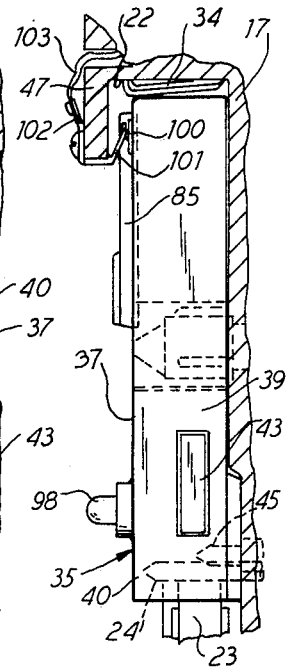
FIG. 3 is a sectional elevational view taken substantially along the line III—III of FIG. 2.
Figure 5:
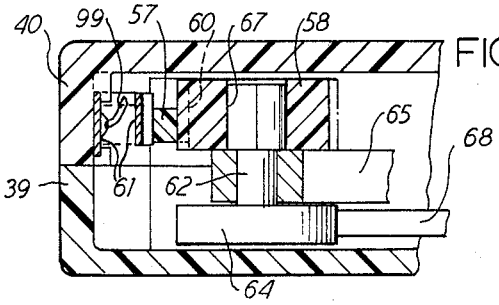
FIG. 5 is an enlarged fragmentary vertical sectional detail view taken substantially along the line V—V of FIG. 6.
Figure 4:
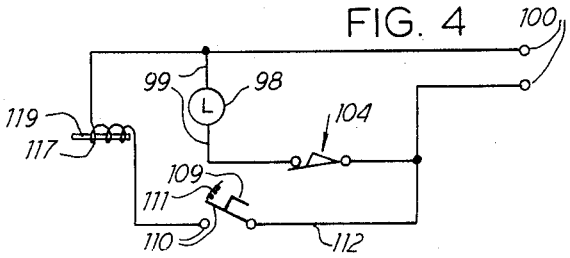
FIG. 4 is an electrical circuit schematic relative to the metronome cartridge and appurtenances.

Means are desirably provided for effecting volitional pauses in the metronomic timing. For this purpose, a foot or digitally operable treadle 109 (FIGS. 1 and 4) may be provided and suitably connected to the timing cam 58 to disable the signal generating reed 49 and the lamp 98. Conveniently, the treadle 109 comprises a normally open switch 110 biased toward open position as by means of a biasing spring 111 against which the treadle 109 is adapted to be maneuvered when a pause of any selected length is desired in the metronomic timing. An operative connection of the foot treadle switch 110 with the timing mechanism including the reed 49 and the operator for the switch 106 is adapted to be effected through an electrical circuit in parallel with the lamp circuit 99 and including an electrical cord 112 having a jack 113 for plugging into an outlet 114 (FIG. 2). Connected with the outlet 114 by means of lead 115 (FIG. 6) is a solenoid 117 which is conveniently mounted on a bracket 118 at the back wall of the base 39 and has an armature 119 operatively connected with the end of an actuating lever extension 120 from the arm 65 on which the rotary cam 58 is mounted. At the junction of the arm 65 with the lever extension 120, a pintle 121 mounts the arm pivotally, so that when the solenoid 117 is energized, the solenoid armature 119 is retracted against a biasing spring 122 and the lever 120 is actuated toward the solenoid 117. The arm 65 is thus rocked away from the transmission disk 68 whereby to diconnect the drive wheel 59 in opposition to the biasing spring 61 to deactivate the reed 49 and the switch 106. The person operating the treadle 109 can thereby volitionally effect as long or short a pause in the metronomic timing as desired. Where multiple beats are desired, such as may comprise a basic beat and a background or minor beat, an arrangement such as depicted in FIG. 10 may be employed. Instead of a single metronomic time generating signal reed to be operated by the timing cam 58, a plurality of such reeds 49' and 49'', shown as two, may be employed. This can be easily effected by superimposing the rocker arms 51' and 41'' of the reeds on the pintle 52, with a bearing washer 123 between the arms. By having the reeds 49' and 49'' of different weights or sizes, distinguishable sound signals are attainable. Where it is desired to have sequential beat signals generated by the reeds 49' and 49'', a modification of the timing cam 58 may be substituted having a separate timing cam track for each of the rocker arms 51' and 51''. For this purpose, the combination spring operator and biasing spring 61 may also be in two parts as well as the switch 106 duplicated, so that the signal lamp 98 may be coordinated with one of the signal generating reeds and a second lamp 98' operated in coordination with the other of the timing reeds. It will be appreciated that such duplication of the spring 61 and the switch 106 is a simple expedient, and is therefore not more specifically shown because one skilled in this art can readily effect such duplication once having been apprised of the basic one switch structure as described in detail.

It will thus be apparent, that the metronome cartridge 35 is a convenient, versatile self-contained unit which can be readily removably inserted in the cassette well 22 of the cassette player 15 in the same manner that a tape cassette can be removably inserted. In other words, as is customary, when the well 22 is empty, the playing head 19 and associated driving wheel 23 and holding finger 25 are retracted. The cartridge 35 can, therefore, be easily maneuvered into place by pushing the back of the cartridge in under the flange 47 and then dropping the cartridge onto the bottom surface defining the well 22. If desired, the treadle 109 may be connected to the cartridge. Automatically upon inserting the cartridge 35 into the well 22, an electrical connection is effected through the terminals 100. To operate the metronome cartridge, the on-off buttom 31 is manipulated to the on position, the volume buttom 32 adjusted to suit, and the play button 28 operated. A function of the play button is, as customary, to shift the head 19 into position and to move the drive wheel 23 into driving relation to the capstan 24 whereby operation of the driving transmission is initiated and time signals generated through the pickup head and the lamp 98. At the beginning of operation or from time-to-time, the timing speed may be adjusted through the adjustment arm 85, especially where the cassette player 15 may not have a speed adjustment facility. If it is desired to use a headphone, that can be readily jacked into the outlet 21. When it is desired to stop the operation, that can be easily effected by either pressing the stop button, or the eject button. The metronome cartridge 35 can be readily interchanged with a tape cassette, as desired.

It will be understood that variations and modifications may be effected without departing from the spirit and scope of the novel concepts of this invention.

I claim as my invention:

1. In combination with a cassette player having driving means:

a metronome cartridge having a body adapted to be removably received in operative relation to the player interchangeably with tape cassettes;

and tape-free mechanical means carried by said cartridge body and adapted to be driven by said driving means for generating metronomic time signals in the operation of said player.

2. A combination according to claim 1, wherein said player has a pickup head and an amplifier system, said means carried by said cartridge body for generating metronomic time signals comprises reed means, and mechanism for causing said reed means to move in operative relation to said pickup head in a timed sequence for generating said metronomic time signals through said head for amplification by said amplifier system.

3. A combination according to claim 1, wherein said player has a pickup head and an amplifier system, said mechanical means comprise a plurality of reeds and mechanism for causing the reeds to move in operative relation to said pickup head in a desirable order for amplification of the signals thereby generated by said amplifier system.

4. A combination according to claim 1, wherein said mechanical means comprise means for controlling a visual signaling device.

5. A combination according to claim 4, including an electrical lamp carried by said cartridge, an electrical circuit for said lamp, and said controlling means controlling said electrical circuit.

6. A combination according to claim 1, including a device for adjusting said mechanical means, to modify the sequence of said time signals.

7. A combination according to claim 1, including a device for volitional pause control over said mechanical means.

8. A combination according to claim 1, wherein said cassette player has a capstan and means for driving said capstan rotatably, and said mechanical means comprises a power transmission means for converting power from the rotating capstan to operate said metronome time signals generating means.

9. A combination according to claim 8, wherein said transmission means includes a timing cam, and said means for generating metronomic time signals includes structure having a cam follower operated by said timing cam.

10. A metronome cartridge, comprising:

a cartridge body adapted to be removably mounted in a cassette player having driving means;

and tape-free mechanical means carried by said cartridge body and adapted to be driven by said driving means for generating metronomic time signals in the operation of said player.

11. A metronome cartridge according to claim 10, wherein said means carried by said cartridge body for generating metronomic time signals comprises reed means, and mechanism for causing said reed means to move in operative relation to a pickup head of the cassette player in a timed sequence for generating said metronomic time signals through said head for amplification by an amplifier system of the cassette player.

12. A metronome cartridge according to claim 10, wherein said mechanical means comprise a plurality of reeds for cooperating in signal generating relation within a pickup head of said player, and mechanism for causing the reeds to oscillate in pickup head cooperative relation in a desirable order for amplification by an amplifier system of the cassette player of signals generated by said cooperation with the pickup head.

13. A metronome cartridge according to claim 10, wherein said mechanical means comprise means for controlling a visual signaling device.

14. A metronome cartridge according to claim 13, including an electrical lamp carried by said cartridge, an electrical circuit for said lamp, and said controlling means controlling said electrical circuit.

15. A metronome cartridge according to claim 10, including a device for adjusting said mechanical means, to modify the sequence of said time signals.

16. A metronome cartridge according to claim 10, including a device for volitional pause control over said mechanical means.

17. A metronome cartridge according to claim 10, wherein said mechanical signal generating means comprise power transmission mechanism for converting power from a rotating capstan of the cassette player.

18. A metronome cartridge according to claim 17, wherein said transmission mechanism includes a timing cam, a signal generating device, and a cam follower operated by said timing cam and controlling the operation of said signal generating device for cooperating with a pickup head of the cassette player/.

19. A combination according to claim 1, including a visual signaling device, and means operated by said mechanical means for controlling said device.

20. A combination according to claim 1, comprising a foot treadle and means for releasably connecting said foot treadle to said cartridge for effecting volitional pause control over said mechanical means through said treadle.

21. A combination according to claim 1, wherein said mechanical means comprise a pair of rotary disks housed rotatably within said cartridge and having portions thereof in spaced overlapping relation, means operating between said overlapping portions of the disks and adapted to effect transmission of rotary power from one of the disks of the other of the disks, said one disk being driven by said driving means, and means carried in an accessible position on said cartridge for adjusting said transmission means relative to said disks for modifying the speed of rotation transmitted from said one disk to the other of said disks, and for thus modifying the sequence of said time signals.

22. A combination according to claim 1, wherein said mechanical means includes a visual signaling device, electrical control means for operating said visual signaling device responsive to operations of said mechanical means, and means for effecting electrical connection between said signaling device and said electrical control means.

23. A combination according to claim 1, wherein said mechanical means comprises reed means, mechanism for causing said reed means to move in a pickup head live spot tapping and back-off relation to said pickup head in a desirable order for amplifying timing signals thereby generated.

24. A metronome cartridge according to claim 10, including a visual signaling device, and means operated by said mechanical means for controlling said device.

25. A metronome cartridge according to claim 10, comprising a foot treadle and means for releasably connecting said foot treadle to said cartridge for effecting volitional pause control over said mechanical means through said treadle.

26. A metronome cartridge according to claim 10, wherein said mechanical means comprise a pair of rotary disks housed rotatably within said cartridge and having portions thereof in spaced overlapping relation, means operating between said overlapping portions of the disks and adapted to effect transmission of rotary power from one of the disks of the other of the disks, said one disk being driven by said driving means, and means carried in an accessible position on said cartridge for adjusting said transmission means relative to said disks for modifying the speed of rotation transmitted from said one disk to the other of said disks, and for thus modifying the sequence of said time signals.

27. A metronome cartridge according to claim 10, wherein said mechanical means includes a visual signaling device, electrical control means for operating said visual signaling device responsive to operations of said mechanical means, and means for effecting electrical connection between said signaling device and said electrical control means.

28. A metronome cartridge, comprising:

a chambered cartridge body adapted to be removably mounted in a cassette player having driving means;

means housed within said cartridge body and adapted to be driven by said driving means for generating metronomic time signals in the operation of said player;

and means on said body in a readily accessible position for controlling said means for generating metronomic time signals.

29. A metronome cartridge, comprising:

a cartridge body adapted to be removably mounted in a cassette player having driving means;

means housed within said cartridge body and adapted to be driven by said driving means for generating metronomic time signals in the operation of said player;

said means housed within said body comprising an assembly including relatively rotary disks having adjustable power transmission means for effecting rotation of one of the disks by means of the other of the disks and said other of said disks being adapted to be driven by said driving means;

and means carried by said cartridge body for effecting adjustments of said transmission means for modifying the sequence of said metronomic time signals.

30. In combination with a metronome cartridge comprising:

a cartridge body adapted to be removably mounted in a cassette player having driving means;

and means housed within said cartridge body and adapted to be driven by said driving means for generating metronomic time signals in the operation of said player;

a foot treadle having a flexible connecting device;

and means for connecting said connecting device to said cartridge body for controlling said means for generating metronomic time signals by operation of said foot treadle.

* * * * *